US005983638A

United States Patent [19]

Achten et al.

[11] Patent Number: 5,983,638

[45] Date of Patent: Nov. 16, 1999

[54] HYDRAULIC SWITCHING VALVE, AND A FREE PISTON ENGINE PROVIDED THEREWITH

[75] Inventors: Peter Augustinus Johannes Achten, Eindhoven; Theodorus Gerhardus Potma, Kaag; Maria Pauline Engel, Emmastraat, all of Netherlands

[73] Assignee: Innas Free Piston B.V., Breda, Netherlands

[21] Appl. No.: 08/776,035

[22] PCT Filed: Jul. 26, 1995

[86] PCT No.: PCT/NL95/00260

§ 371 Date: Apr. 28, 1997

§ 102(e) Date: Apr. 28, 1997

[87] PCT Pub. No.: WO96/03575

PCT Pub. Date: Feb. 8, 1996

[51] Int. Cl.[6] ..... F02B 71/04

[52] U.S. Cl. ..... 60/595; 251/30.02

[58] Field of Search ..... 251/30.02, 30.05; 60/595

[56] References Cited

U.S. PATENT DOCUMENTS

| | | | |
|---|---|---|---|
| 3,544,061 | 12/1970 | Moy | 251/30.02 X |
| 4,205,528 | 6/1980 | Grow | 60/595 |
| 4,326,380 | 4/1982 | Rittmaster et al. | 60/595 |
| 4,599,861 | 7/1986 | Beaumont | 60/595 |
| 5,156,080 | 10/1992 | Pelto-Huikko | 251/30.02 X |
| 5,328,147 | 7/1994 | Stobbs | 251/30.02 |
| 5,645,263 | 7/1997 | Aardema | 251/30.02 |

FOREIGN PATENT DOCUMENTS

| | | |
|---|---|---|
| 0333960 | 9/1989 | European Pat. Off. . |
| 9310342 | 5/1993 | WIPO . |

*Primary Examiner*—Hoang Nguyen
*Attorney, Agent, or Firm*—Lahive & Cockfield, LLP

[57] ABSTRACT

An hydraulic switching valve (35) comprises, among other parts, a valve housing (45, 62) with a first connection (33, 36) and a second connection (34, 67) and a valve body (37, 63) which is movable in the valve housing (45). The switching valve (35) is open when the pressure at the first connection (33) is higher than the pressure at the second connection (34) as a result of the fact that the pressure difference caused by the movement of the valve body (37) allows a flow past the valve body (37). The switching valve is closed when the pressure at the first connection (33) is lower than the pressure at the second connection (34) as a result of the fact that the movement of the valve body (37) caused by the pressure difference closes a valve seal (40) which blocks the flow. The switching valve (35) further comprises a lock (39) with switching element (42) for selectively keeping the valve seal (40) closed, and unblocking the valve body (37), respectively.

5 Claims, 6 Drawing Sheets

HYDRAULIC SWITCHING VALVE, AND A FREE PISTON ENGINE PROVIDED THEREWITH

The invention relates to a hydraulic switching valve according to the preamble of claim 1. Such switching valves are known as non-return valves and are used in hydraulic systems to ensure a proper operation thereof.

The flow in the conduit in which the valve is incorporated moves the valve body and the valve body blocks the flow in the conduit when it is pressed sealingly against the housing by this flow and the pressure generated by it, as a result of which this valve closes very quickly and also opens very quickly again after reversal of the direction of flow.

Because of its conventional structure, this non-return valve is only adapted for blocking a liquid flow through a conduit in one single direction and for unblocking the conduit very quickly when the pressures on the conduit connections are reversed. The opening of the valve is achieved within a very short time as a result of the fact that the valve body clears the entire flow opening at once under the influence of the pressure on the conduit connections.

It has been found that there is a need for a valve which remains closed for some time after the reversal of the pressures on the conduit connections, and which opens after the flow in the conduit has been unblocked by a control system, whereupon the liquid starts to flow.

The present invention aims to provide a hydraulic valve which opens very quickly after receiving a signal to that end, thereby unblocking a large oil flow.

To achieve this, the valve is executed in accordance with the characterizing part of claim 1.

By using a non-return valve, which can be locked in the direction of flow, a quick-switching valve is obtained. The short switching time chiefly results from the fact that the pressure difference across the valve is also responsible for the movement of the valve body, so that the latter can move very quickly and thus unblock the conduit completely within a very short time.

In a specific application, the hydraulic switching valve is employed as a starting valve in the hydraulic control system of a free-piston engine as described hereinafter with reference to FIG. 1. In such an engine, the power of the engine is determined by, among other factors, the stroke frequency, which is determined to a large extent by the rate at which the starting valve can open and take the oil supply from the pressure accumulator to the chamber to the maximum value thereof, without inadmissible flow losses. In conventional embodiments of this type of starting valve, the valve consists of an electrically actuated valve which unblocks the oil flow. Since the oil flow to be unblocked here is large, this usually implies that the electric part must be designed accordingly large, as a result of which the valve switches slowly, so that the maximum attainable frequency of the engine, and hence the maximum power that can be generated by the engine, will be limited. On the other hand, when the starting valve given a small size, allowing it to switch quickly, the pressure drop in the oil flow owing to flow losses in the starting valve becomes too big, resulting in a poor hydraulic efficiency of the engine. The oil flow rate is also lower in that case, as a result of which the free piston starts more slowly and the stroke frequency again is limited.

The aim of the invention is to provide a free-piston engine in which a large oil flow can be unblocked within a very short time, so that an engine with a high stroke frequency can be obtained.

To this end, the engine is provided with a starting valve according to one of claims 1–5.

By incorporating the quick-switching valve in the conduit between the pressure accumulator and the chamber, it is possible to have the engine make a new stroke shortly after the piston assembly has come to a standstill on the outer dead centre. Thus, the frequency of the engine can be controlled between a low value and a high value.

The invention is further explained with reference to the drawing with figures showing the application of a hydraulic switching valve in a free-piston engine as well as various embodiments of this switching valve.

In the figures, which show various exemplary embodiments of the switching valve in addition to an application thereof, corresponding parts are designated as much as possible by identical reference numerals.

Figure 1:
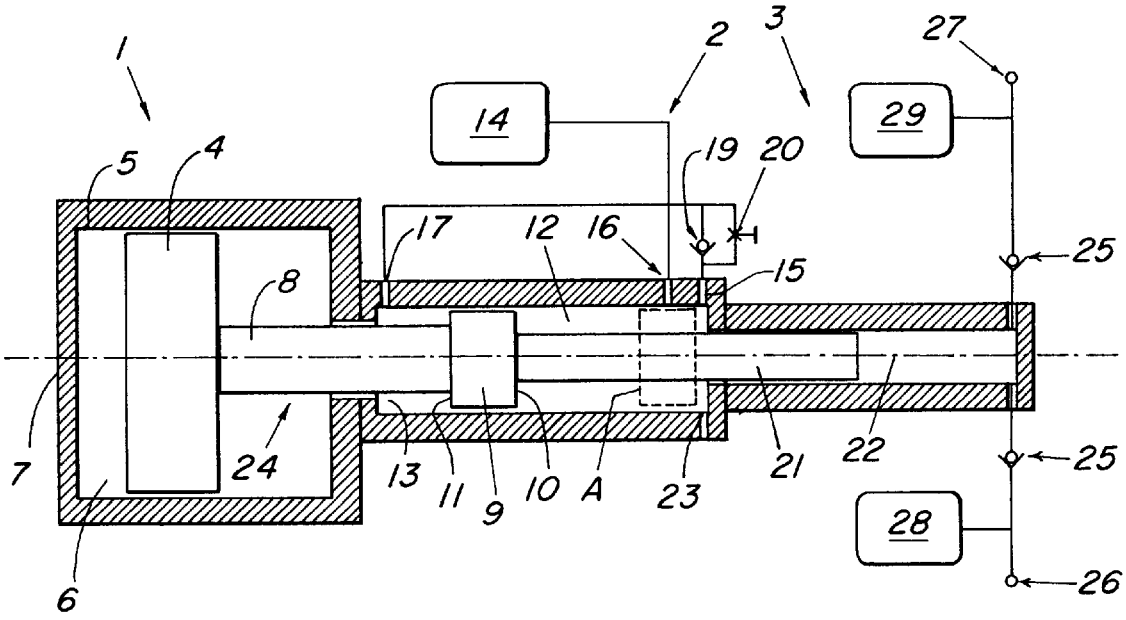
FIG. 1 is a schematic sectional view of a free-piston engine, provided with a hydraulic switching valve.

FIG. 1 shows a free-piston engine, consisting of a combustion part 1, a hydraulic control system 2 and a pump 3. In the combustion part 1, a combustion piston 4 is reciprocatable in a combustion cylinder 5. The combustion cylinder 5, the combustion piston 4 and a cylinder head 7 together define a combustion space 6. In the combustion space 6, fuel mixed with air is ignited, whereby the chemical energy of the fuel is released in the form of gas pressure.

In the free-piston engine shown here, the engine has a combustion space, which is defined by one combustion piston. However, other engines are known in which two combustion pistons are placed opposite each other in one combustion cylinder.

The combustion can be started in several known ways, such as those applied in crank-connecting rod engines. An example of these is the two-stroke diesel process, in which the fuel is injected into the combustion space 6 in a way which is not further specified, after the combustion piston 4 has compressed the combustion air to the pressure and temperature required for ignition.

The compression of the air above the combustion piston 4, which is required in each internal combustion engine, is accomplished during a compression stroke. During this stroke, the combustion piston 4 moves from an outer dead centre A, i.e. the position in which the volume of the combustion space 6 is at a maximum, to an inner dead centre, i.e. the position in which the volume of the combustion space 6 is at a minimum. During this movement, energy is supplied to the combustion piston 4 by means of hydraulic pressure, which in turn supplies this energy to the air in the combustion space 6.

The energy supply to the combustion piston 4, as well as the standstill of the piston on the outer dead centre A, are accomplished by means of the hydraulic control system 2, which is coupled to the combustion piston 4 by means of a piston rod 8. A hydraulic piston 9 and a piston rod 21 are attached to the piston rod 8. The combustion piston 4, the piston rod 8, the hydraulic piston 9 and the piston rod 21 together form a piston assembly 24. The hydraulic piston 9 is reciprocatable in a hydraulic cylinder 23.

The hydraulic cylinder 23 and a first surface 10 of the hydraulic piston 9 define a first chamber 12, which communicates with a pressure accumulator 14 via a channel 15 and a channel 16. The hydraulic cylinder 23 and a second surface 11 of the hydraulic piston 9 define a second chamber 13, which communicates with the pressure accumulator 14 via a channel 17. The first surface 10 is larger than the second surface 11.

The channel 16 is closed by the hydraulic piston 9 when the combustion space 6 has approximately attained its maximum volume and the hydraulic piston 9 is near the outer dead centre A. In this position, the first chamber 12 and the pressure accumulator 14 are exclusively connected via the channel 15, by means of a conduit in which a non-return valve 19 and a starting valve 20 are positioned parallel to each other. The non-return valve 19 is positioned in such a way that oil can flow with little resistance from the first chamber 12 to the pressure accumulator 14. The starting valve 20 is actuated by an engine control system (not shown), which causes the engine to generate the required energy.

The operation of the hydraulic control system 2 is as follows: as long as the piston assembly 24 stands still on the outer dead centre, the channel 16 is closed by the hydraulic piston 9. The second surface 11 is subjected to the pressure reigning in the pressure accumulator 14. The starting valve 20 is closed and since the second surface 11 is smaller than the first surface 10, the pressure in the first chamber 12 is lower than that in the second chamber 13, and the non-return valve 19 is closed. The free-piston engine starts another stroke at the moment the starting valve 20 opens to start the compression stroke. After the hydraulic piston 9 has passed the channel 16, the first chamber 12 will be filled through this channel.

Simultaneously with the movement of the piston assembly 24 during the compression stroke, oil is pushed to the pressure accumulator 14 or to the first chamber 12 via the channel 17. The channel 16, which has a large diameter, is positioned in such a way that the hydraulic piston 9 clears the opening as soon as possible after the start.

During the compression stroke, energy is supplied to the piston assembly 24, which in turn supplies this energy to the air in the combustion space 6. This combustion air is introduced into the combustion space 6 by a known air supply system, which is not further specified. The compressed combustion air brakes the movement of the piston assembly 24 in the direction of the combustion space and the piston assembly 24 stops on the inner dead centre.

The starting valve 20 can be closed from the moment the hydraulic piston 9 clears the opening of the channel 16, and has to be closed before the moment the hydraulic piston 9 closes this opening again during an expansion stroke, i.e. the movement of the piston assembly 24 from the inner dead centre to the outer dead centre.

On the inner dead centre, combustion is started by the engine control system, corresponding to known engine control systems and not further specified here, which is coupled to, among other parts, the starting valve 20, the fuel system and one or more sensors measuring the energy demand of the users. Combustion is started, for example, by fuel injection or by ignition of the fuel-air mixture by a spark. The igniting mixture pushes the piston assembly 24 to the outer dead centre, and the energy released in the combustion process is partly stored in the pressure accumulator 14 and partly consumed via the pump 3. The piston assembly 24 comes to a standstill on the outer dead centre and remains in this position until the starting valve 20 is opened again by the engine control system and a new stroke is started.

The pump 3 consists of a non-return valve 25 in both a suction conduit 26 and a discharge conduit 27 and the piston rod 21, which defines a space 22. The supply and discharge conduits 26 and 27 are, for example, connected to a hydrostatic engine (not shown). The pump 3 maintains a pressure difference between a high pressure accumulator 29 and a low pressure accumulator 28.

When this hydrostatic engine rotates and consumes energy, the pressure in the high pressure accumulator 29 decreases. This is detected by the sensors coupled to the engine control system, which actuates the engine to make a new stroke by opening the starting valve 20. The control system further assures, among other functions, serves to supply the fuel required for a certain energy consumption to the combustion space and to cause the ignition to take place in time.

The pressure in the high pressure accumulator 29 is determined by the consumption; this pressure can be very low or, on the contrary, incidentally or over prolonged periods very high. The pressure in the pressure accumulator 14 is maintained as much as possible at a constant level, so that the engine control system can operate optimally.

Besides the control means described hereinbefore, other known auxiliary systems are provided, such as the system that takes the piston assembly to the outer dead centre if no ignition has taken place at the end of the compression stroke, and an oil suppletion system, which maintains the pressure in the pressure accumulator 14 at the desired level.

Figure 2:
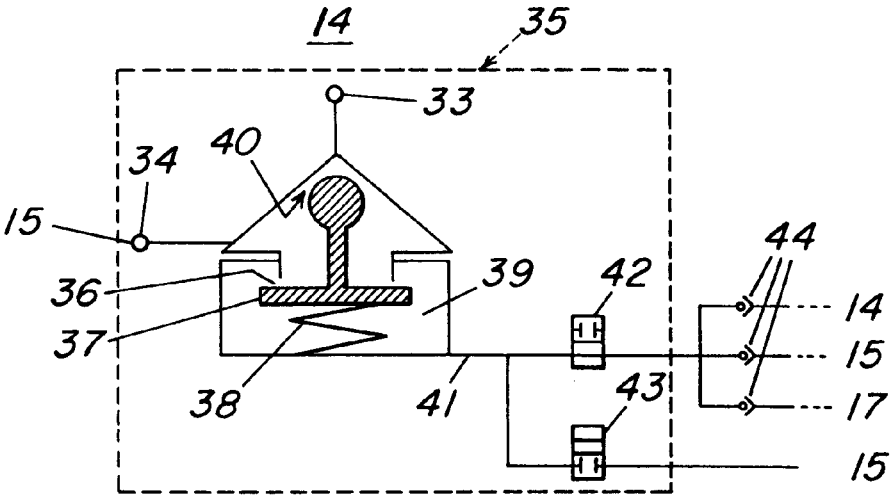
FIG. 2 is a diagram showing the operation of the hydraulic switching valve according to the invention.

FIG. 2 schematically shows the operation of a hydraulic switching valve 35 according to the invention. This hydraulic switching valve 35, by means of which a large oil flow can be started very quickly and, with the oil flow undergoing little flow-resistance, can, for example, be used as a starting valve 20 in the engine shown in FIG. 1. In that case, a first connection 33 is connected to the pressure accumulator 14 shown in FIG. 1 and a second connection 34 is connected to the channel 15.

The hydraulic switching valve 35 is open when the pressure at the first connection 33 is higher than the pressure at the second connection 34. A valve body 37 blocks the oil flow at a valve seat 40 when the pressure at the second connection 34 is higher than that at the first connection 33. This blocking already occurs at equal pressures, owing to the resilience of a spring 38.

The hydraulic switching valve 35 differs from known non-return valves in that the valve body 37 can be locked in the position in which the oil flow is blocked, by an oil pressure to be provided to a pressure chamber 39. When the hydraulic switching valve 35 is closed, the pressure chamber 39 is closed by a valve seat 36. Locking the valve body 37 in the closed position is achieved by providing the highest system pressure to the pressure chamber 39 via an electrically actuated valve 42. In the example of FIG. 1 for example, this is accomplished by connecting the electrically actuated valve 42 to the accumulator 14 by means of a non-return valve 44, to the first chamber 12 via the channel 15 or to the second chamber 13 via the channel 17. By using non-return valves, one achieves that the pressure reigning in the pressure chamber 39 remains the highest of the system, also during pressure impulses.

When the lock is engaged, an electrically actuated valve 43 is closed. Through this electrically actuated valve 43, the pressure chamber 39 can be connected to a low pressure-point. In the example of FIG. 1, this can be the pressure reigning in the first chamber 12.

The lock is disengaged by opening the electrically actuated valve 43 simultaneously with or shortly after closing the electrically actuated valve 42. Then the electrically actuated valve 35, which is used as the starting valve 20 in FIG. 1, opens, owing to the fact that the valve body 37 becomes detached from the valve seat 40, and the compression stroke of the piston assembly 24 can start.

The electrically actuated valves 42 and 43 can be very small, because the main flow from the first connection 33 and towards the second connection 34 only passes the valve body 37 through the opening between the valve seat 40 and the valve body 37. Since the electrically actuated valves 42 and 43 are very small, their switching time can be less than a millisecond, allowing the hydraulic switching valve 35 to open completely within some milliseconds.

Figure 3:
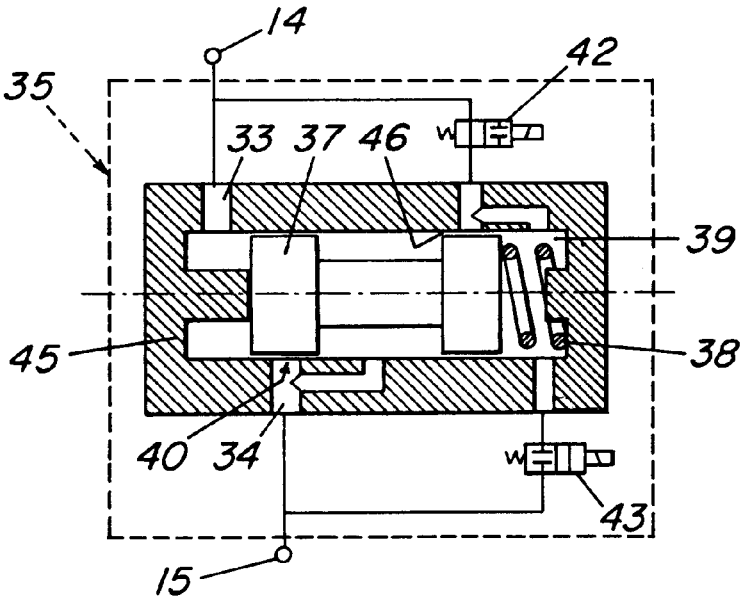
FIG. 3 is a schematic sectional view of the hydraulic switching valve in a first embodiment.

FIG. 3 shows a section of a first embodiment of the hydraulic switching valve 35 according to FIG. 2, having two sliding seals between the valve body 37 and a valve housing 45. The valve body 37 is slidingly reciprocatable. The isolable pressure chamber 39 can maintain the valve body 37 in such a position that flow between the first connection 33 and the second connection 34 is prevented. The spring 38 causes the valve body also to return to the right starting position in the absence of oil pressures, although the force of the spring is small in comparison with the forces caused by the pressure differences.

By decreasing the pressure in the pressure chamber 39 when the valve is locked, for example by opening the switching valve 43, the valve body 37 can move in the direction of the pressure chamber 39 due to the pressure at the first connection 33, whereupon the oil can flow from the pressure chamber 39 to the second connection 34 past a seal 46 that is being opened. When the valve body 37 moves further, the seal 40 is completely opened as well and, within a very short time, a connecting channel with a very low flow resistance is established between the first connection 33 and the second connection 34.

Figure 4:
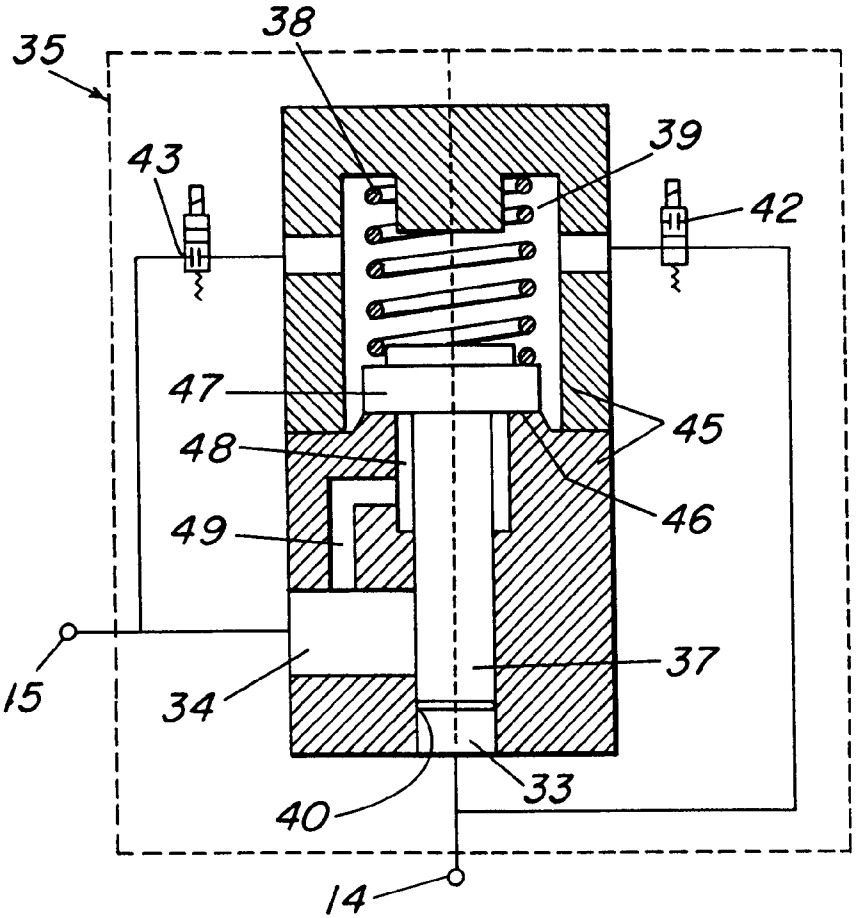
FIG. 4 is a schematic sectional view of the hydraulic switching valve in a second embodiment.

FIG. 4 shows a sectional view of a second embodiment of the hydraulic switching valve 35 according to FIG. 2. In this embodiment, the first connection 33 on the two-part valve housing 45 is connected to a source of pressure, for example the pressure accumulator 14. The second connection 34 is connected to a point of low pressure, for example through the channel 15. In the two-part valve housing 45, the valve body 37 is slidingly movable under oil pressure. In the position represented in FIG. 4, the switching valve 35 is closed and the valve body 37 blocks the flow from the first connection 33 to the second connection 34 at the seal 46. A disc 47 attached to the valve body 37 is pressed sealingly against the seal 46. This seal 46 isolates the pressure chamber 39 from a space 48 which is connected to a second connection 34 via a channel 49.

The pressure chamber 39 is connected to the first connection 33 via the electrically actuated switching valve 43 and to the second connection 33 via the switching valve 42. The valve body 37 is pressed on the valve seat 46 by the spring 38.

When the pressure in the pressure chamber 39 is at least equal to the pressure at the first connection 33 as a result of the electrically actuated valves 42 and 43 being in the right position, the direction of the force on the valve body 37 will always be such that the valve remains closed, owing to the fact that the diameter of the disc 47 at the seal 46 is larger than the diameter of the valve body 37 at the seal 40.

Figure 5:
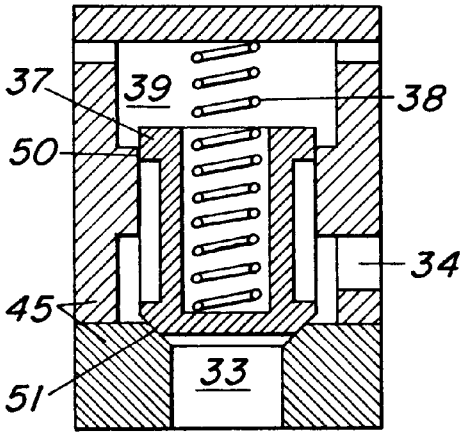
FIG. 5 is a schematic sectional view of the valve and the valve housing of the switching valve in a third embodiment.

FIG. 5 shows a third embodiment of the valve and the valve housing of the switching valve. This embodiment is comparable to the embodiment according to FIG. 4, in which the pressure chamber 39 has a sliding seal 50 between the valve body 37 and the valve housing 45. A seal 51 between the first connection 33 and the second connection 34 is fitted with a valve seat. The surface of the seal 51 is smaller than that of the sliding seal 50 of the isolable pressure room 39.

Figure 6:
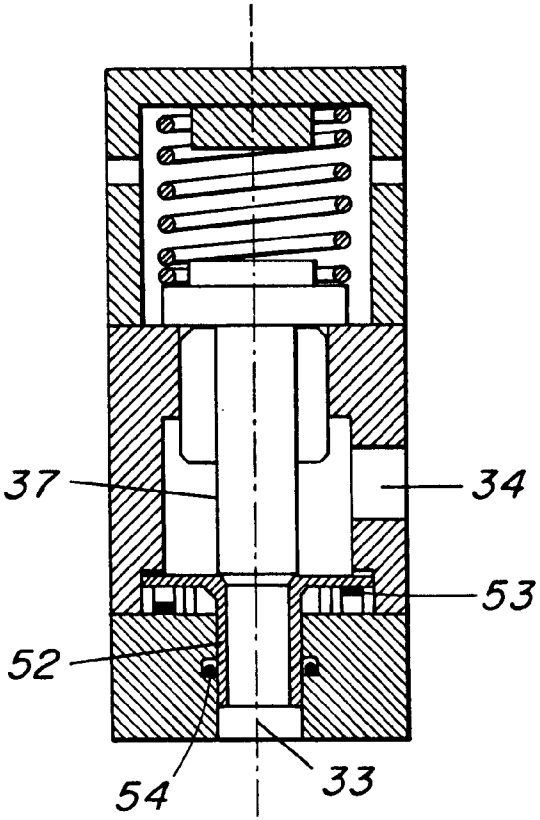
FIG. 6 is a schematic sectional view of the valve and the valve housing of the switching valve in a fourth embodiment.

FIG. 6 shows a fourth embodiment of a valve and a valve housing comparable to the switching valve according to FIG. 4. In this embodiment, both seals, i.e. that between the first connection 33 and the second connection 34 and that between the pressure chamber 39 and the second connection 34, are fitted with a valve seat. In order to achieve that both seals operate properly and that they can be conveniently manufactured, one of these seals, in the example shown the seal between the first connection 33 and the second connection 34, is executed as a resilient seal. In this seal, the valve body 37 sealingly abuts on a resiliently movable seat 52, a spring ring 53 pressing the seat 52 against the valve body 37. A sealing ring 54 prevents oil from leaking past the resilient seat 52.

Figure 7:
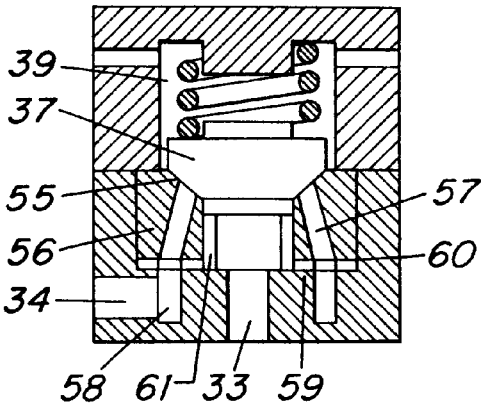
FIG. 7 is a schematic sectional view of the valve and the valve housing of the switching valve in a fifth embodiment.

FIG. 7 shows a fifth embodiment of the valve and the valve housing, in which a sealing face 55 provides the seal of the isolated pressure chamber 39 as well as the seal between the first connection 33 and the second connection 34. In this embodiment, a valve body 37 sealingly abuts on a sealing ring 56, which is made of a somewhat elastic plastic, such as POM. Halfway at the sealing face 55, the sealing ring 56 is provided with holes 57 all round, which join into a groove 58 connected to the second connection 34. The total surface of the holes 57 approximately corresponds to the surface of the second connection 34. The sealing ring 56 is supported by a flat ring 59, provided with a number of holes 60 which correspond to the holes 57 in the sealing ring 56, and is supported on its inside by a bush 61. Thus, the plastic material constituting the sealing ring 56 is enclosed on all sides, preventing permanent deformations of the sealing face in use.

Figure 8:
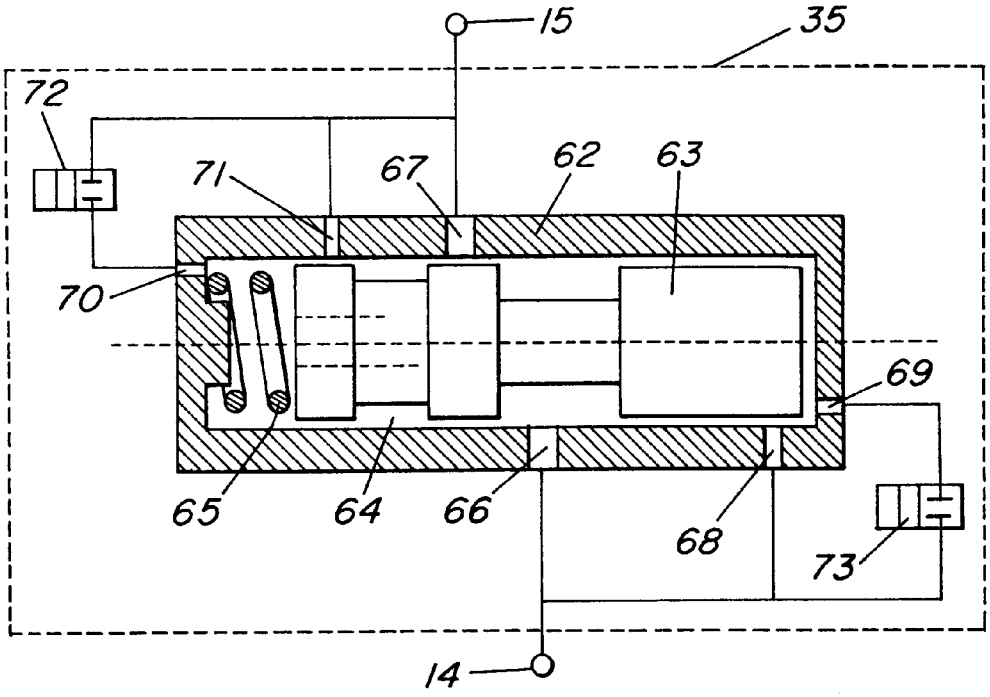
FIG. 8 is a schematic sectional view of the hydraulic switching valve in a sixth embodiment.

FIG. 8 shows a sixth embodiment of a hydraulic switching valve 35, the operation of which slightly differs from the diagram shown in FIG. 2. The switching valve 35 consists of a housing 62, containing a slidable valve body 63, said valve body 63 comprising a bore 64. In the unloaded configuration, the valve body 63 is pressed by a spring 65 to a starting position in the valve housing 62. When the switching valve 35 shown is used as a starting valve 20 in FIG. 1, a first connection 66 is for example connected to the pressure accumulator 14 and a second connection 67 is connected to the channel 15. The first connection 66 and the second connection 67 are large, so that the main flow through the hydraulic switching valve 35 can take place with little resistance.

The movement of the valve body is influenced by the channels in the valve housing 62, the first connection 66 being connected to a control channel 68 and, via an electrically actuated valve 73, to a control channel 69, and the second connection 67 being connected to a control channel 71 and, via an electrically actuated valve 72, to a control channel 70.

The hydraulic switching valve 35 closes when the pressure at the second connection 67 is higher than the pressure at the first connection 66. During closing, both the electrically actuated valve 72 and the electrically actuated valve 73 are open and the valve body 63 moves, partly by the force of the spring 65, in such a way that it blocks the second opening 67. Locking the closed position is achieved by closing the electrically actuated valves 72 and 73, so that the hydraulic switching valve 35 remains closed when the pressure at the first connection 66 becomes higher than the pressure at the second connection 67.

The hydraulic switching valve 35 opens when the pressure at the first connection 66 is higher than that at the second connection 67 after opening both electrically actuated valves 72 and 73. The valve body 63 will then start to move to the left, and after the valve body has cleared the openings 68 and 71, the movement of the valve is no longer hindered by the small flow openings of the electrically actuated valves 72 and 73, and the valve body 63 will thus quickly and completely unblock the flow from the first connection 66 to the second connection 67. The valve closes again when the pressure at the first connection 66 becomes lower than that at the second connection 67.

Figure 10:
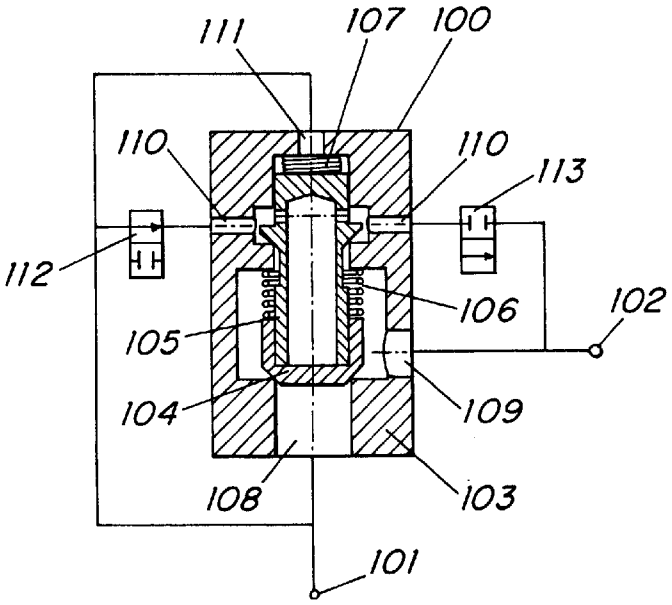
FIGS. 9 and 10 show a schematic section and a circuit of a hydraulic valve and a valve housing in a seventh embodiment.
Figure 9:
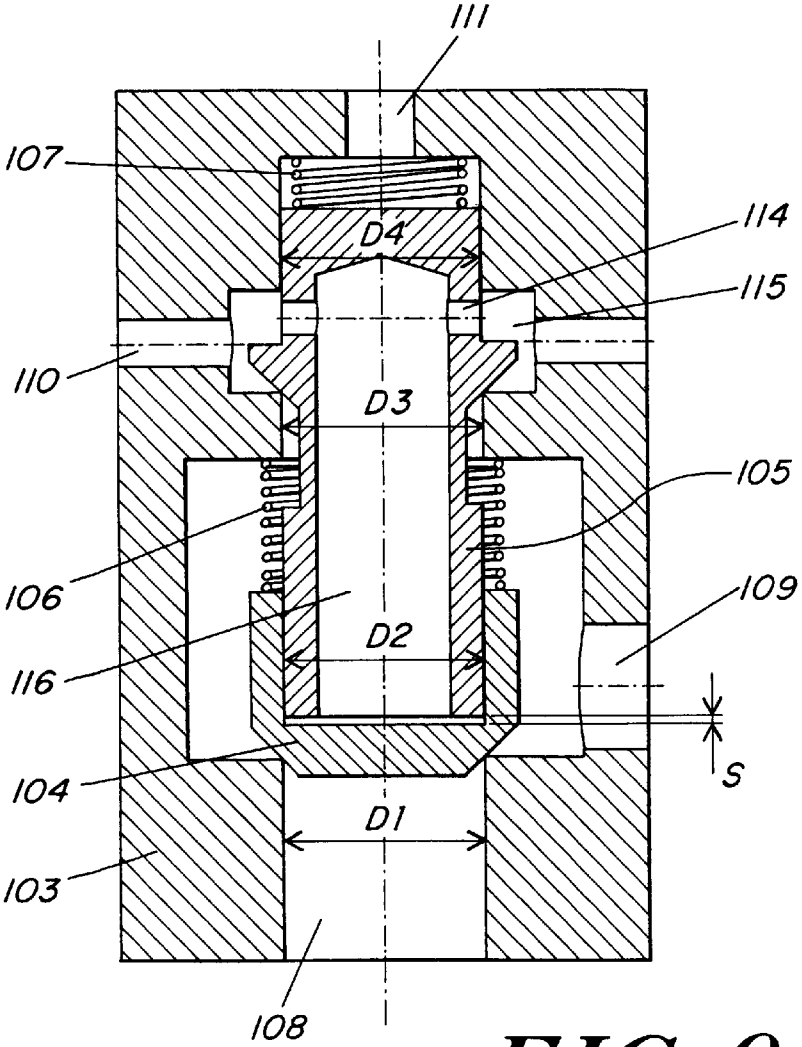

FIG. 9 shows a seventh embodiment of the switching valve, while FIG. 10 shows the control of the valve, corresponding parts in these figures being designated by identical numerals. A connection 101 shown in FIG. 10 corresponds to the connection 14 in FIG. 2 and a connection 102 in FIG. 10 corresponds to the connection 15 in FIG. 2.

In a valve housing 103, which may consist of more than one part, a first valve body 104 is mounted, which is held on a valve seat with a diameter $D_1$ by means of a spring 105. In addition, a second valve body 105 is mounted in the valve housing 103, which is held on a valve seat with a diameter $D_3$ by means of a spring 107. The second valve body 105 can move as a piston in a cylindrical channel with a diameter $D_4$. The second valve body 105 is executed in the form of a tube which is open on one side, with an outer diameter $D_2$, while the first valve body 104 can close the open tube, so that a chamber 116 is formed. When both valve bodies 104 and 105 rest on their valve seats, there is a gap S between the valve bodies, as a result of which the first valve body can become detached from its valve seat over the width of this gap S.

By sealing the valve seats with two separate valve bodies 104 and 105, the seal is ensured. The gap S can be kept very small, preferably about 0,1 mm, allowing quick opening of the valve. The width of the gap S is determined by, among other factors, the manufacturing tolerances for the various parts of the valve.

The flow from a first connection 108 to a second connection 109 can be blocked by placing the first valve body 104 on the valve seat. This closed position can be locked by putting the second valve body 105 via a connection 111 and the cylindrical channel with a diameter $D_4$ under pressure and, in addition, by putting a locking space 115 under pressure via a valve 112, with the valve 113 closed, so that the chamber 116 is put under pressure as well via an opening 114.

The valve remains closed as long as the pressure in the locking space 115 is high. As soon as the locking space 115 is connected to a point of low pressure, for example the second connection 109, via a channel 110 and the valve 113, the valve opens. First, the first valve body 104 starts to move and, after bridging the gap S, it pushes open the second valve body, as a result of which volume S*(surface $D_2$) flows through the valve 113. Then, the liquid from the locking space 115 does not need to flow via the valve 113 any more, so that the size of the valve 113 can be reduced to a minimum, allowing an increase in the speed of the valve.

The dimensions of the valve are dependent on the switching times and the flow openings of the valves 112 and 113, and on the required flow openings and the required switching times. Calculations of various diameters have yielded a number of values giving optimum results in certain situations. It has thus been found that $D_2$ needs to be larger than $D_1$, for example 1 to 10%, in order to keep the valve in a stable closed position, even in the case of pressure fluctuations which may result from 14 quick switching. $D_2$ and $D_3$ are approximately equal and $D_4$ is much smaller than $D_3$, for example $0{,}7*D_3$, because the mass of oil to be accelerated upon opening the valve is smaller in that case.

Figure 11:
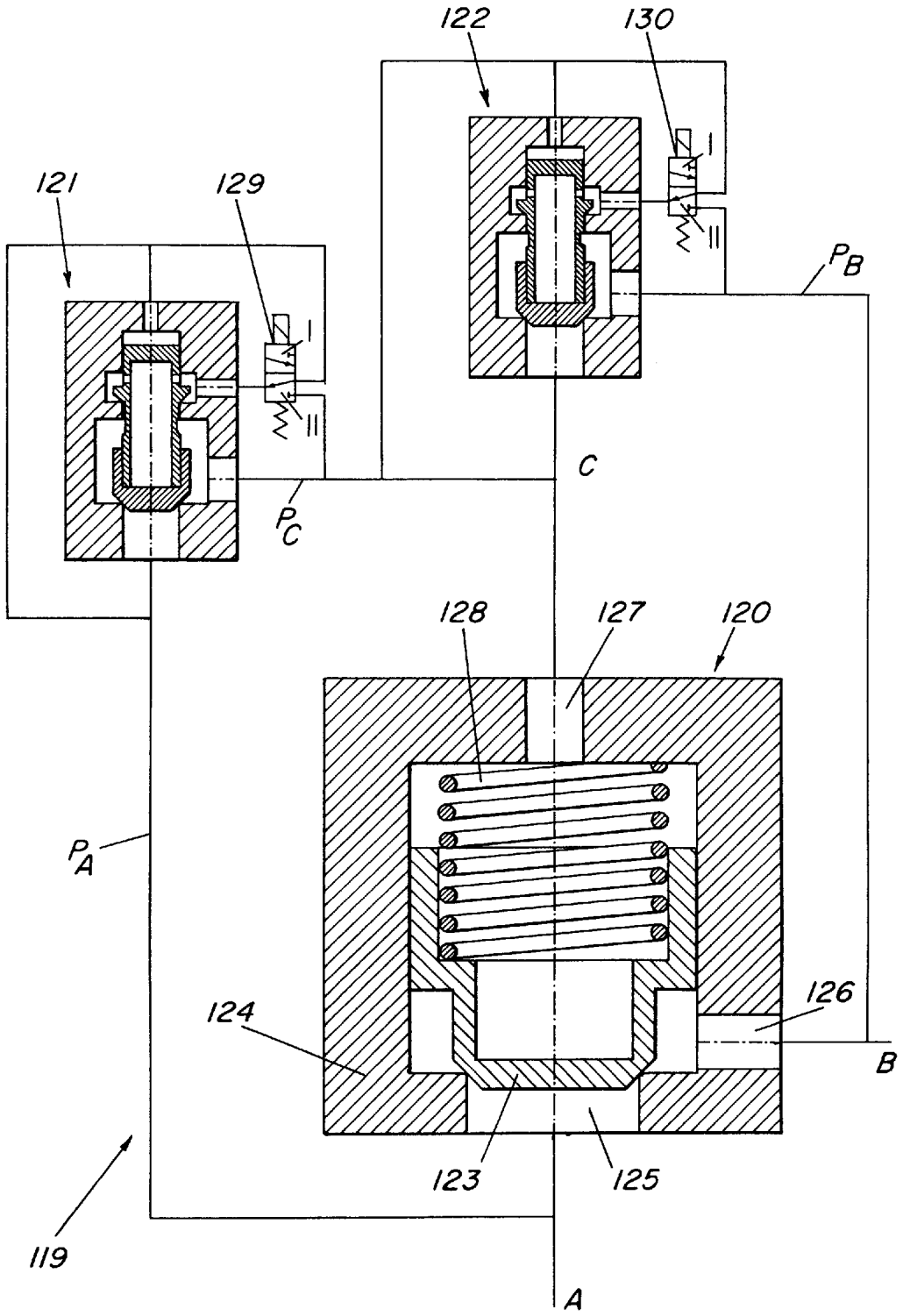
FIG. 11 is a hydraulic diagram of a circuit by which an oil channel can be opened and closed quickly, provided with switching valves according to the seventh embodiment.

FIG. 11 shows a hydraulic circuit 119 in which two quick valves according to FIG. 10 are combined with a pressure-controlled valve 120. By means of this circuit, a large oil flow flowing in either direction between A and B can be switched at a high frequency.

This circuit can be used for controlling, for example, hydraulic cylinders by means of pulse interval modulation or for starting a free-piston engine according to FIG. 1. The circuit 119 according to FIG. 11 is then connected to the channel 15 according to FIG. 1 at A and to the accumulator 14 at B. The connection 16, which is hard to manufacture, can then be omitted. The switching circuit 119 then comes in the place of the valves 19 and 20.

The large oil flow between A and B is switched by a pressure-controlled valve 120, wherein a valve body 123 can move in a housing 124 and block the flow between a connection 125 and a connection 126. The valve body 123 moves under the influence of the pressure difference between a pressure $P_A$ at the connection 125, a pressure $P_B$ at the connection 126 and a pressure $P_C$ at a connection 127. The housing also contains a spring 128.

The valve 120 is actuated by a valve 121 and a valve 122 which correspond to the valve 100 shown in FIGS. 9 and 10. The valves 121 and 122 are switched by means of the quick-actuatable valves 129 and 130.

Thanks to the short switching times of the quick valves 129, which actuate the valves 121 and 122 switching on a small oil flow, which in turn actuate the valve 120, the oil flow between A and B can be unblocked and blocked within a very short switching time, wherein short may mean some milliseconds. The switching is of course followed by a short time interval druing which the pressures of the volumes in the various parts can be restored and during which the various valve bodies take up the position required for the next switching action.

The embodiments shown in the figures concern a valve in which locking is achieved by means of hydraulic pressure. It is, however, also possible, to effect the locking of the valve body simply in a mechanical way. These ways are taken to be common knowledge and are not further specified here.

Furthermore, the actuatable valves in the exemplary embodiments are executed as electrically actuated valves that are coupled to a control system. It is, however, just as well possible to execute the actuatable valves in a different way, for example as hydraulically actuated valves or as valves that are directly controlled by the movements of the instrument concerned.

We claim:

1. A hydraulic switching valve comprising a valve housing with a first connection and a second connection, a valve body movable within the valve housing between an open position and closed position, a closeable pressure chamber formed by the valve housing and the valve body and a spring between the valve housing and the valve body exerting a force on the valve body directed towards the valve body's closed position, wherein the valve body has first and second surfaces on opposite sides, and wherein in the closed position pressure in the first connection works on the first surface of the valve body and pressure in the pressure chamber works on the second surface of the valve body, and the projected area of the second surface in the movement direction is at least equal to the projected area of the first surface, whereby a small displacement of the valve body from the closed position opens a channel between the pressure chamber and the first connection or the second connection.

2. The hydraulic switching valve of claim 1, whereby a first seal between the valve body and the valve housing forming the first surface and/or a second seal between the valve body and the housing forming the second surface is resiliently movable relative to the valve housing.

3. The hydraulic switching valve of claim 1, whereby the valve body comprises a first valve body section and a second valve body section whereby a first seal is formed between the first valve body section and the valve housing forming the first surface, and a second seal is formed between the second valve body section and the valve housing forming the second surface which valve body sections are slideably moveably relative to one another.

4. The hydraulic switching valve of claim 3, comprising a spring on each valve body section exerting a force in a direction towards a closed position for the first and the second seal.

5. The hydraulic switching valve of claim 3 comprising a second pressure chamber between the first seal and the second seal.

* * * * *

UNITED STATES PATENT AND TRADEMARK OFFICE

CERTIFICATE OF CORRECTION

PATENT NO. : 5,983,638
DATED : November 16, 1999
INVENTOR(S) : Achten et al.

It is certified that error appears in the above-identified patent and that said Letters Patent is hereby corrected as shown below:

Title page Insert:

item [30] Foreign Application Priority Data

Jul. 27, 1994 [NL] Netherlands .....9401232

At column 7, line 29, change "105" to --106--.

At column 8, line 39, after "129", insert --and 130--.

At column 8, line 44, correct spelling of "druing" to --during--.

Signed and Sealed this

Sixth Day of June, 2000

*Attest:*

Q. TODD DICKINSON

*Attesting Officer*

*Director of Patents and Trademarks*